US007752703B1

(12) United States Patent
Silva

(10) Patent No.: US 7,752,703 B1
(45) Date of Patent: Jul. 13, 2010

(54) ARTICULATED APPARATUS FLAT BLADE HAND TOOL

(76) Inventor: Edward Silva, 7287 Havenside Dr., Sacramento, CA (US) 95831

( * ) Notice: Subject to any disclaimer, the term of this patent is extended or adjusted under 35 U.S.C. 154(b) by 1042 days.

(21) Appl. No.: 11/447,793

(22) Filed: Jun. 6, 2006

Related U.S. Application Data

(60) Provisional application No. 60/689,396, filed on Jun. 9, 2005.

(51) Int. Cl.
*B05C 17/10* (2006.01)

(52) U.S. Cl. ..... 15/245.1; 15/235.8

(58) Field of Classification Search ..... 15/245.1, 15/235.4–235.6, 235.8, 236.01, 236.05, 239; 425/458
See application file for complete search history.

(56) References Cited

U.S. PATENT DOCUMENTS 745,126 A * 11/1903 Warson ..... 15/235.8
1,021,557 A * 3/1912 Runner ..... 15/145
1,590,342 A * 6/1926 Abram ..... 15/235.8
3,090,066 A * 5/1963 Ferrell, Jr. et al. ..... 15/235.8
3,803,662 A * 4/1974 Glejf ..... 15/245.1
6,295,689 B1 * 10/2001 Sciacca ..... 15/245.1

* cited by examiner

*Primary Examiner*—Dung Van Nguyen
(74) *Attorney, Agent, or Firm*—Kali Law Group, P.C.

(57) ABSTRACT

The present invention is a type of hand tool apparatus for use as a trowel, scrapper, spatula and others. The tool comprises a handle, to which a plate member is securely coupled. A blade member is securely attached to the plate member; the blade member having opposing parallel edges of typically unlike configurations. The handle has a locking device that is pressure sensitive and provides a means to immobilize the pivot mechanism and secure and lock in place the blade member. Activated by the user, such as finger/thumb manipulation, disengagement and release of the locking device allows the pivot mechanism to operate and the blade member to rotate from the first blade edge to the second blade edge. The new method and novel tool allows for achieving a consistently uniform layer of compound spread much more rapidly and with a reduction of material waste and reduces the need for two or more tools needed in task succession.

12 Claims, 10 Drawing Sheets

ARTICULATED APPARATUS FLAT BLADE HAND TOOL

CROSS-REFERENCE TO RELATED APPLICATION

This application is a Continuation to Provisional Patent Application No. US60/689,396 filed on Jun. 9, 2005, and which is incorporated herein by reference in its entirety and for all purposes.

BACKGROUND

Field of the Invention

The present invention generally relates to a hand tool that provides a means to spread a compound material in a consistently uniform layer without the necessity for multiple repetitive applications and multiple application tools. The present invention is well suited for use in the construction industry; and particularly well suited for use with dry wall.

Construction practice has employed the use of various hand tools requiring multiple repetitive applications to achieve spreading a compound material, such as in a consistently uniform layer.

There are many trowel designs and styles made for spreading a compound material in a consistently uniform layer. There are finish work trowels, flexible contouring and finishing trowels, integrally formed handle trowels adapted for injection mold manufacturing, combination groover trowel, spackle holder trowel, adjustable blade assembly trowels, various compound dispensing and spreading apparatus, spreaders, hinged trowels, two sided trowels, corner adjustable trowels, finishing trowels, caulk and glazing tools, grout spreaders, trowel blinds, molded handled trowels, hinged trowels, multiple handle trowels, radius surface trowels, bull and or hand float trowels, plastering trowels, flexible trowels, scrapers, adhesive trowels, ergonomic trowels, leveling trowels, smoother trowels, finishing trowels, etc. These and other known devices of the prior art have not addressed the speed and still require multiple applications interspersed with adequate drying time between applications and the use of more than one tool, hence the large number of types of trowels.

Therefore the need exists for a method and apparatus to allow for an improvement in the field successive slightly different tool use during operations. What is needed is a method and a hand tool apparatus that is quick to apply and provides for a consistently uniform layer of compound spread without the necessity of multiple repetitive applications interspersed with adequate drying times between applications and the use of more than one tool. The use of multiple tools requires additional skill and learning and produces the need for a method and a tool that allows for a lower level of skill required to achieve a consistently uniform layer and reduces the drying time and reduces the tendency of the compound to crack and reduces material waste.

SUMMARY

The present invention discloses a tool apparatus using flat blades for surface working, comprising a handle, a blade member having at least first and second working edges, a plate member coupling the handle to the blade member, a pivot mechanism coupling the plate member and the blade member, and the blade member free to pivot to selectively extend either of the first or second working edges, whereby a user can actively set alternate working edges while using the tool.

In a trowel embodiment of the invention, a commonly known principal is used in a novel way to expedite the spreading of a compound in a consistently uniform layer without the necessity of multiple repetitive applications and the time involved thereof or changing tools.

The invention includes additional embodiments to embellish the blade utility and tool flexibility to quickly change blades instead of tools, using the right blade for the correct purpose and intended use, instead of a make shift solution with incorrect tools taken because the correct tool was unavailable or not locatable in the time required.

DETAILED DESCRIPTION

Figure 1:
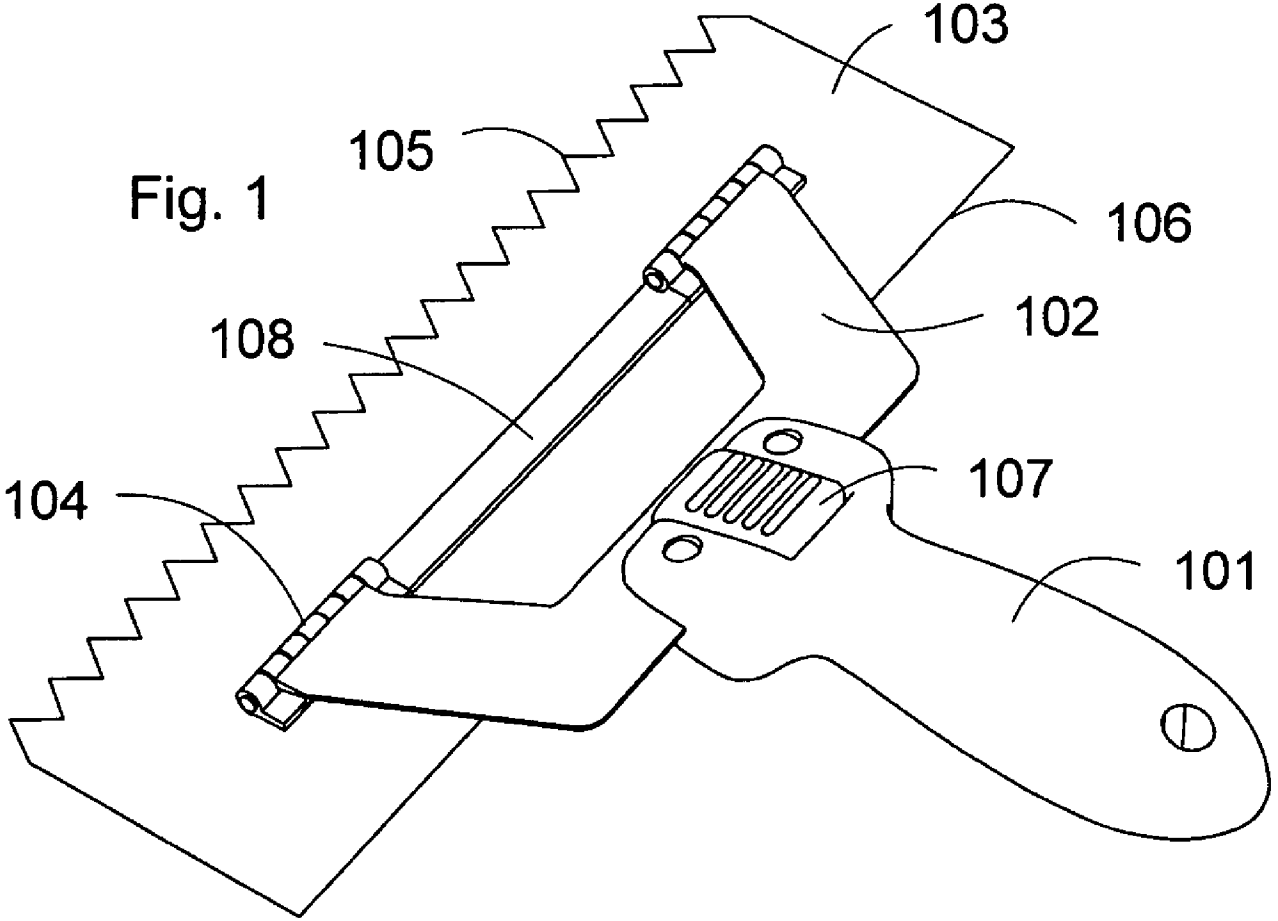
FIG. 1 is an isometric illustration of a trowel tool for spreading a compound in a consistently uniform layer according to one embodiment of the present invention.

Specific embodiments of the invention will now be described in detail with reference to the accompanying figures.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

OBJECTS AND ADVANTAGES

The present invention is a method and a hand tool that saves a user time and provides a means to work a surface. The purpose of the surface work can be to spread a consistently uniform layer of compound without the necessity of multiple repetitive applications and the time required thereof.

Accordingly, it is an object of the present invention to provide an easy to use method and apparatus for spreading a compound.

It is another object of the present invention to provide a method and apparatus for spreading a compound that reduces the time required to achieve a consistently uniform layer.

It is a further object of the present invention to provide a method and apparatus for spreading a compound to achieve a consistently uniform layer with a lower level of skill.

The number of tools required to do even small jobs can be large and finding and using the proper tool for any part of the job can increase the time required. It is a further object of the present invention to provide a method and apparatus for quickly changing flat blades required for different surface workings without the necessity to change tools.

Further still, it is an object of the present invention to provide a method and apparatus for spreading a compound that allows for a reduction in material waste. Even further, it is another object of the present invention to provide a method and apparatus for spreading a compound that can be used with a wide variety of materials.

It is another object of the present invention to provide a method and apparatus for spreading a compound that one or more elements of the tool can be detachable whereby a means to accommodate varying sizes and blade edge configurations is possible.

It is another object of the present invention to provide a method and apparatus for spreading a compound consistently uniform that is much more efficient than any prior technology available.

Finally, another object of the invention is to provide a tool with multiple and diverse edges for surface work, such that the tool provides different edges for different purposes. Surface working includes but is not limited to spreading of compound, scraping, smoothing, cutting, polishing or cleaning a surface.

In general, embodiments of the invention provide an apparatus to allow a hand tool used as trowel, scraper, or other use to interchange the blade required for each task, and in a simple way reduce the task time while maintaining all other tool uses and tasks.

LABELS OF ELEMENTS IN FIGURES

The figure labels are related across figures, with the label number of a corresponding element ending with the number listed representing the element name list below, being applied consistently with only the 3 digit changed across figures to correspond with the figure number listed below.

(1) a handle
(2) a plate member
(3) a blade member
(4) a pivot mechanism
(5) a blade edge or the initial application blade edge
(6) the opposite blade edge or the finishing blade edge
(7) the locking device
(8) the blade stabilizer The present invention, an easy, efficient, time saving method and hand tool apparatus for use in spreading a compound in a consistently uniform layer as in a trowel embodiment, or an interchangeable blade tool in another embodiment.

FIG. 1 is an isometric illustration of a trowel tool for spreading a compound in a consistently uniform layer according to one embodiment of the present invention.

In an embodiment of the invention in FIG. 1, the component members are listed as a handle 101, a plate member 102, a blade member 103, a pivot mechanism 104, one blade edge or the initial application blade edge 105, an opposite blade edge or the finishing blade edge 106, a locking slider 107, and a blade stabilizer 108.

The hand tool consists of several components, one of which is a handle 101, which can be formed conventionally or configured in any desired shape amenable to manual manipulation. Another component is a plate member 102 that is securely mounted in the distal area of the gripping portion of the handle 101 and according to this embodiment is substantially perpendicular to the handle 10). It will be appreciated that the handle-plate connection may be offset a desired distance or angle without departing from the teachings herein. The plate member 102 is coupled to a pivot mechanism 104, for example a hinge or any other pivoting means. It should be appreciated that the plate and pivot mechanism may be integral to one another without departing from the teachings herein. Another component is a blade member 103 that is securely mounted to the plate member 102, perpendicular to the handle 101. The blade 103 is preferably constructed from a thin firm material, having a length and width much greater than the blade 103 thickness. In one embodiment, a range of thickness of about 30-60 mil with a blade width in the range of 8-18 inches. In one preferred embodiment the blade is constructed from a section of steel sheet, such as stainless steel. In another embodiment, the blade 103 is securely coupled to blade stabilizer 108.

Figure 2:
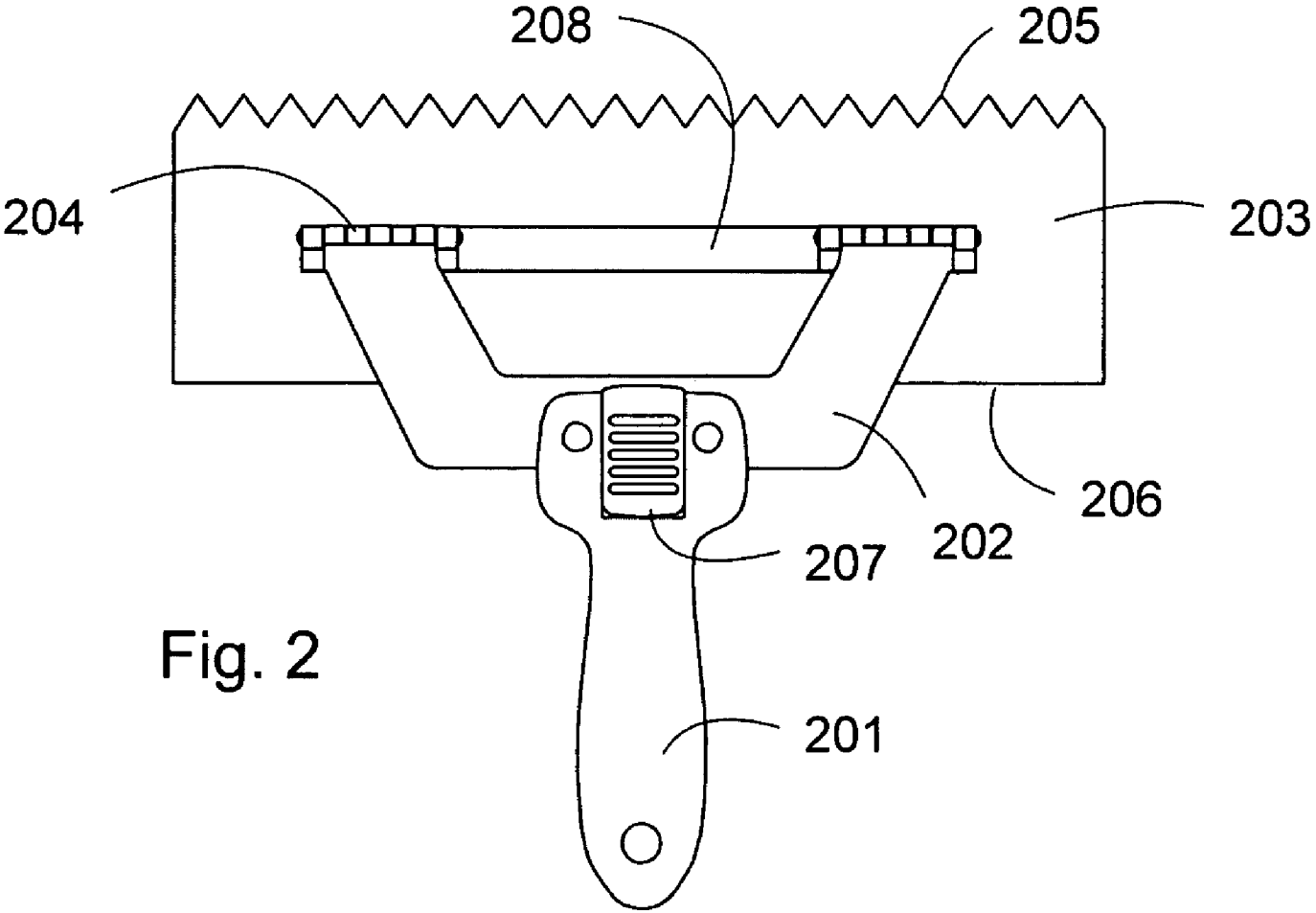
FIG. 2 is a top view of a trowel tool in accordance with an embodiment of the invention.

FIG. 2 is a top view of a trowel tool in accordance with an embodiment of the invention.

In an embodiment of the invention in FIG. 2, borrowing all else from FIG. 1, the component members are listed as a handle 201, a plate member 202, a blade member 203, a pivot mechanism 204, one blade edge or the initial application blade edge 205, an opposite blade edge or the finishing blade edge 206, a locking slider 207, and a blade stabilizer 208.

Figure 3:
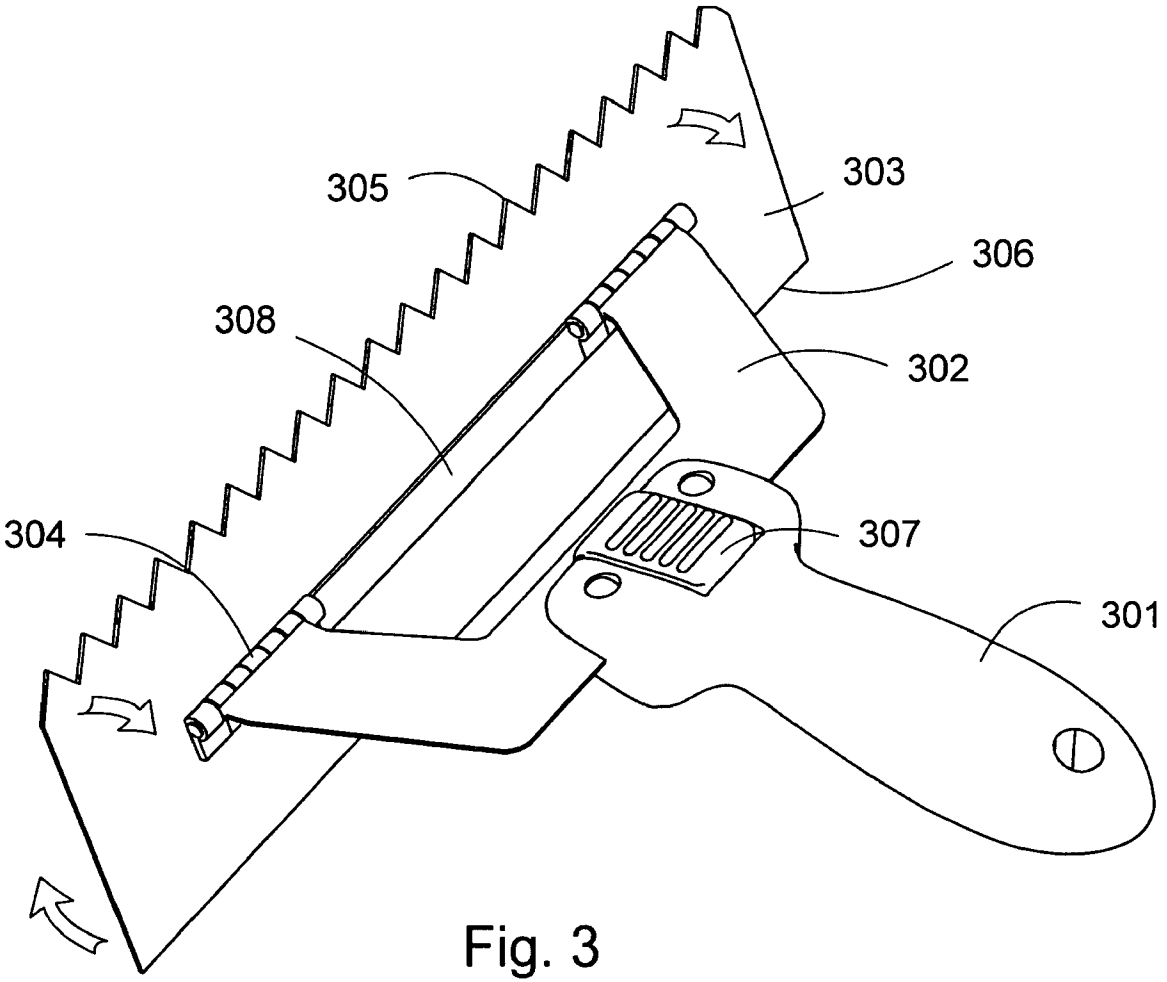
FIG. 3 is an isometric illustration showing an activated pivot mechanism in an aspect of the invention.

FIG. 3 is an isometric illustration showing an activated pivot mechanism in an aspect of the invention.

In an embodiment of the invention in FIG. 3, and maintaining consistency of figure label numbers across the figures, the component members are listed as a handle 301, a plate member 302, a blade member 303, a pivot mechanism 304, one blade edge or the initial application blade edge 305, an opposite blade edge or the finishing blade edge 306, a locking slider 307, and a blade slider stabilizer 308.

The pivot mechanism 304 allows the blade member 303 to rotate from one blade edge 305 to the opposite blade edge 306. Offering by selection either blade edge 305, or blade edge 303 for use; allowing the user in a quick easy motion to swap between blade edges without the need of getting out another tool or cleaning the first tool. It should be appreciated that the opposing blade edges would preferably have different edge patterns, for example straight, triangle, spike, curved, wavy, random, soft-edge, and so forth. The patterns shown in the figures are provided by way of example and not by way of limitation.

In another embodiment, the pivot mechanism 304 is coupled to a plate member 302 which transfers the pivot rotation to a translation mechanism coupled to the locking 307 mechanism or the handle 301. The handle 301 can have various embodiments for holding, gripping or rotating the tool. The handle 301 may also house the pivot rotator to handle 301 via plate 302 element coupler or locking mechanism. The handle 301 may be made of material suitable for the tools purpose and function which may be most cost effective to manufacture. Some embodiments my use thin handles and some embodiments thick, round, gripping, revolving, etc.

Figure 4:
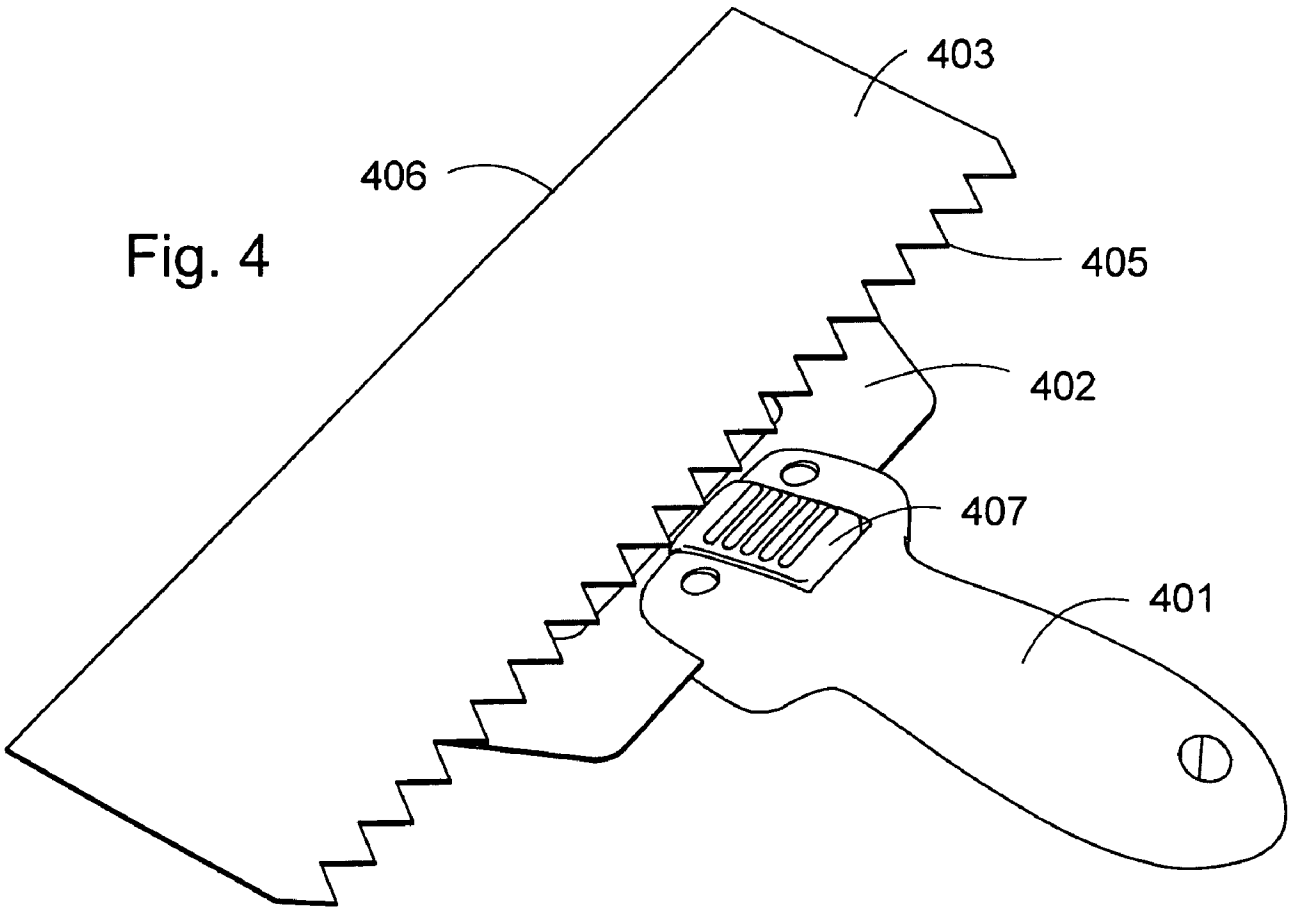
FIG. 4 is an isometric view illustrating the position of an activated locking mechanism highlighting two opposing blade edges in accordance with an embodiment of the invention.

FIG. 4 is an isometric view illustrating the position of an activated locking mechanism highlighting two opposing blade edges in accordance with an embodiment of the invention.

In an embodiment of the invention in FIG. 4, and maintaining consistency of figure label numbers across the figures, the component members are listed as a handle 401, a plate member 402, a blade member 403, a pivot mechanism 404, one blade edge or the initial application blade edge 405, an opposite blade edge or the finishing blade edge 406, a locking slider 407, and a blade slider stabilizer 408.

In the embodiment shown, blade member 403 is configured with opposing, parallel edges, which is pivoted 180 degrees and now has the opposite edge 406 protruding outwardly from the handle 401. Blades 403 are also interchangeable and pivotal about a perpendicular axis which is preferably substantially perpendicular to the handle 401. In one embodiment, the blade edge 405 contains a plurality of like dimensional adjacent alternating triangular shapes and conversely positioned triangular spaces. The opposite blade edge 406 may be flat and unadorned. The handle 401 has a locking slider 407 positioned, whereby a firm grip is provided without hindrance or compromising the stability of handling the tool.

Figure 5:
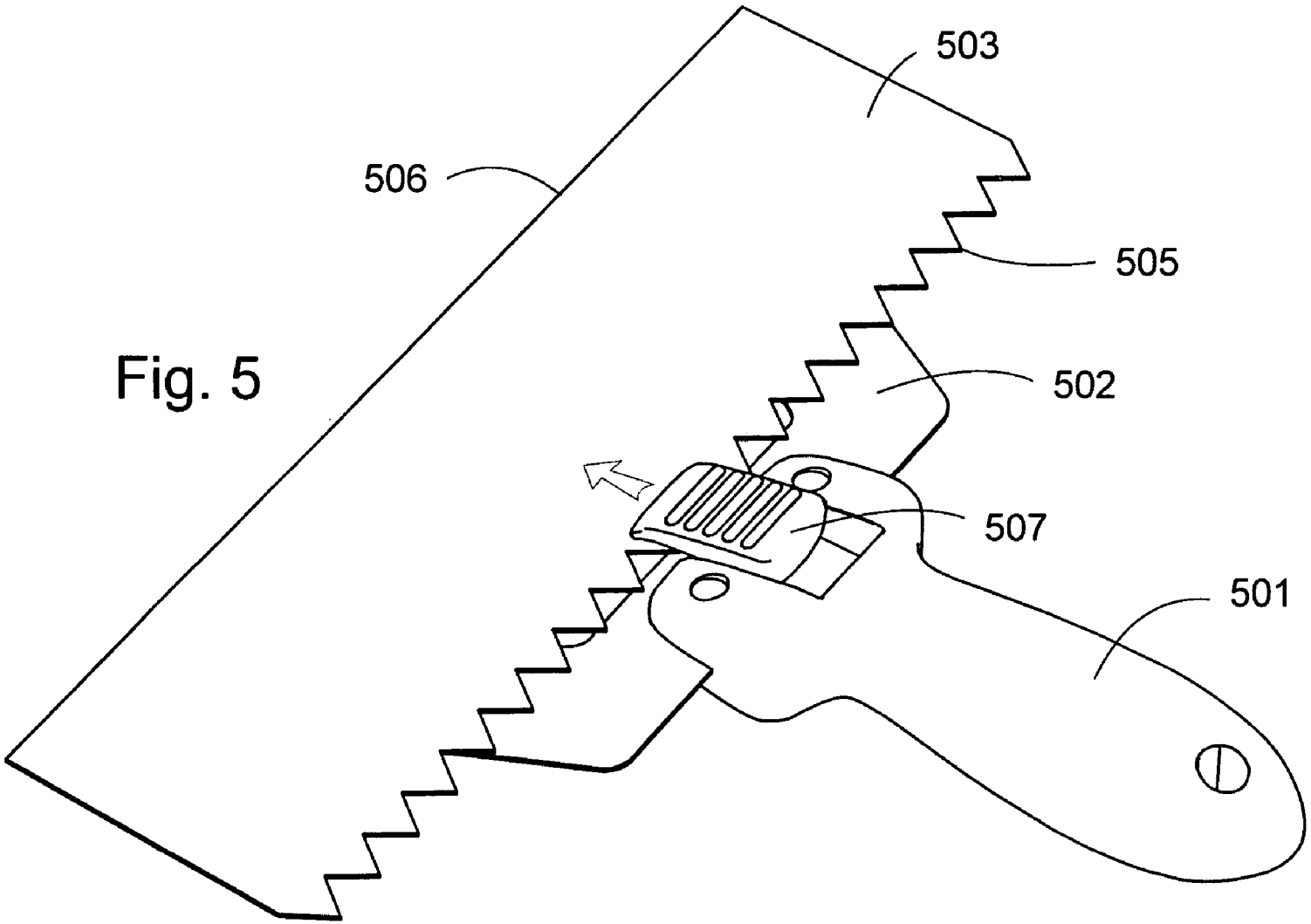
FIG. 5 is an isometric view illustrating the position of an activated locking mechanism highlighting an immobilized, secured and locked blade member in accordance with an embodiment of the invention.

FIG. 5 is an isometric view illustrating the position of an activated locking mechanism highlighting an immobilized, secured and locked blade member in accordance with an embodiment of the invention.

In an embodiment of the invention in FIG. 5, and maintaining consistency of figure label numbers across the figures, the component members are listed as a handle 501, a plate member 502, a blade member 503, a pivot mechanism 504, one blade edge or the initial application blade edge 505, an opposite blade edge or the finishing blade edge 506, a locking slider 507, and a blade slider stabilizer 508.

Using the invention embodiment in FIG. 4, FIG. 5 illustrates the activated locking mechanism aspect as a slider 507 riding on the handle 501. The handle 501 has a locking slider 507 positioned, in the locked position for the opposite side 506 of the blade 503. Furthermore, the handle 501 provides a firm grip without hindrance or compromising to the stability of handling the tool or edge changes without user intent.

Figure 6:
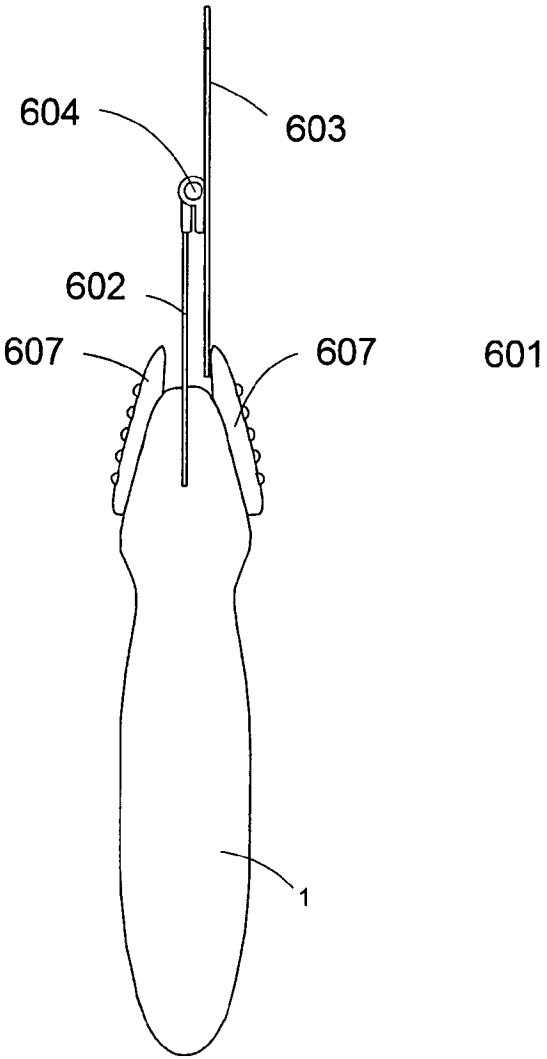
FIG. 6 is a side view drawing illustrating the handle-blade pivot mechanism in a secured and locked position in accordance with an embodiment of the invention.
Figure 7:
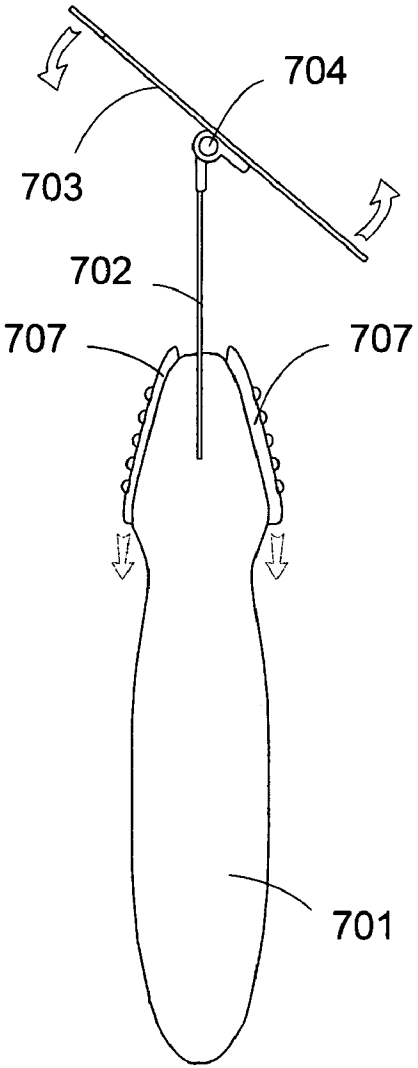
FIG. 7 is a side view of the tool showing the release mechanism activated and the pivot mechanism operational.

FIG. 6 and FIG. 7 are side view drawings illustrating the handle-blade pivot mechanism in a secured and locked position and the release mechanism activated with the pivot mechanism operational to provide the alternate edge respectively in accordance with an embodiment of the invention.

This embodiment of the locking device 607 707 is positioned on one or more sides of the handle 601 701 in close proximity and protruding slightly over the perpendicularly attached plate member 602 702 and blade member 603 703, whereby the pivot mechanism 604 704 is immobilized and the blade member 603 703 is secured and locked into place. The locking device 607 707 is pressure sensitive, having a pressure sensitive mechanism that is activated by contact with a blade edge; one blade edge 605 705 or the opposite blade edge 606 706; whereby the locking device 607 707 retracts towards the gripping portion of the handle 601 701 thereby allowing one blade edge 605 705 or the opposite blade edge 606 706 to pass and the blade member 603 703 to become parallel with the plate member 602 702, thereupon the locking slider 607 707 returns to the original position to immobilize the pivot mechanism 604 704 and secure and lock in place the blade member 603 703. In other embodiments, the pivot mechanism is activated from the handle or locking mechanism, such that pressing, sliding or rotating the handle or locking mechanism will engage the pivot mechanism to rotate the blade with one handed operation. In yet another embodiment, activated by a finger manipulation, the locking device 607 707 has a release mechanism that disengages the locking device 607 707, releases the blade member 603 703 and activates the pivot mechanism 604 704. The position of the release mechanism of the locking device 607 707 allows for a firm grip on the handle 601 701 and simultaneously allows for finger manipulation without hindrance or compromising the stability of handling the tool. It will be appreciated that many forms of locks may be implemented on the tool for retaining the blade in a desired position. These various lock forms may be integrated within the handle or plate member as would be apparent to one of ordinary skill in the art without departing from the teachings of the present invention.

The tool may be fabricated in any number of alternative ways according to the invention. In some embodiments, the blade elements 603 703 are fabricated from steel (or other metal), and in some embodiments the blade member 603 703 may be welded spot, TIG, arc, etc. or coupled in any other fashion or process to the selective blade stabilizer and pivot mechanism 604 704 or the opposite side of the plate member 602 702. In yet another embodiment the blade components can be attached to one another with rivets, or other forms of fasteners. The handle 601 701 is preferably attached to plate member 602 702 using rivets, threaded fasteners, adhesives, other fastening forms or combinations thereof. It can also be appreciated that the blade components can be less preferably fabricated from materials other than steels, such as composite material such as but not limited to carbon fiber composites, ceramic composite, and the like.

Figure 8:
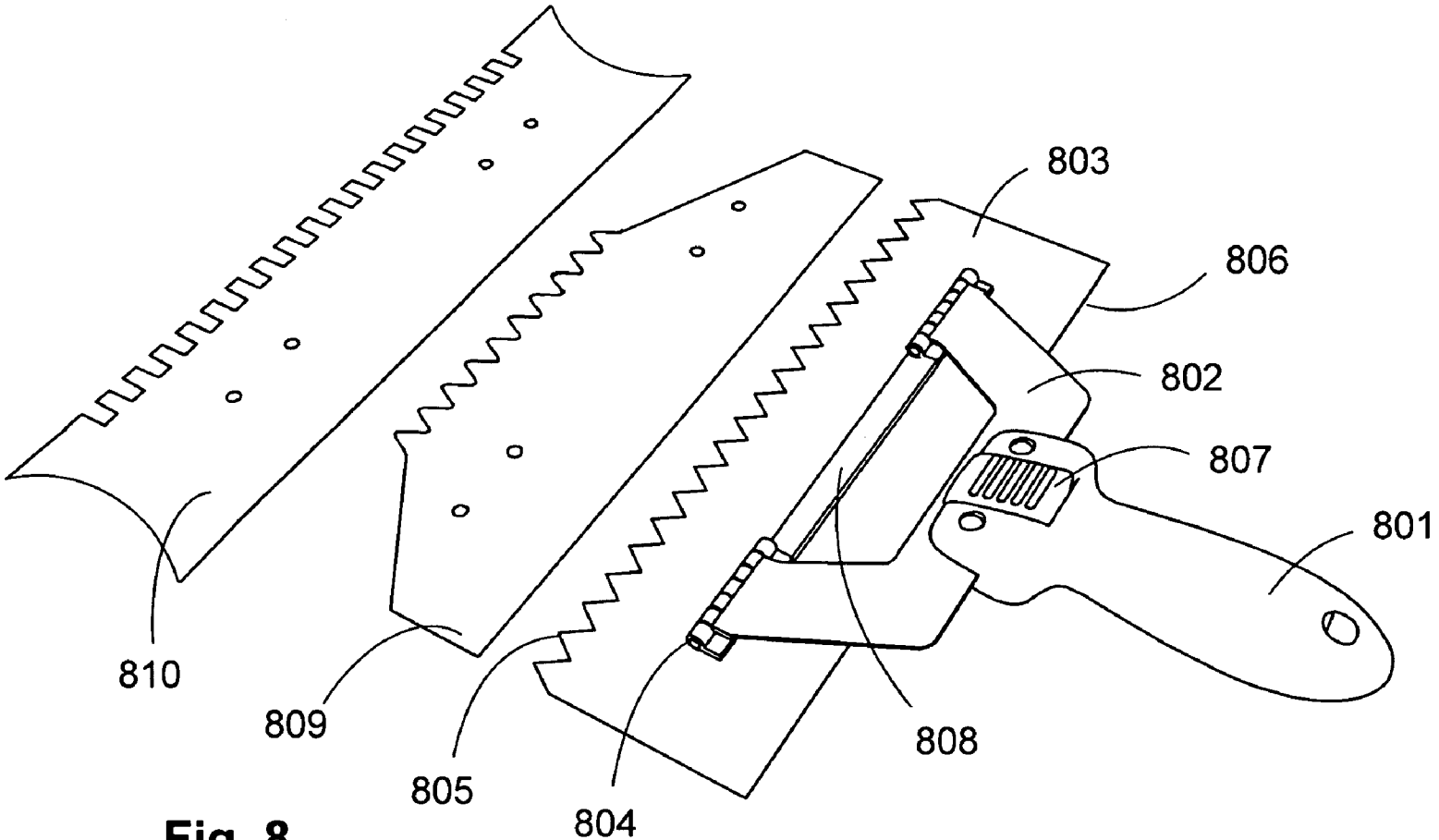
FIG. 8 is an isometric view illustrating the interchangeability of alternate blades and blade types in accordance with an embodiment of the invention.

FIG. 8 is an isometric view illustrating the interchangeability of alternate blades in accordance with an embodiment of the invention.

In accordance with an embodiment of the invention method provided, a compound is spread initially utilizing one blade edge 805 that has a plurality of like dimensional adjacent alternating triangular shapes and conversely triangular spaces. Activated by a finger manipulation, the release mechanism of the locking device 807 disengages the locking device 807 and releases the blade member 803 which allows the pivot mechanism 804 to operate and the blade member 803 to rotate from one blade edge 805 or the initial application blade edge 805 to the opposite blade edge 806 or the finishing blade edge 806 wherein, contact of the finishing blade edge 806 with the pressure sensitive mechanism of the locking device 807 disengages and retracts the locking device 807 thereby allowing the finishing blade edge 806 to pass and the blade member 803 becomes parallel to the plate member 802, thereupon the locking mechanism 807 returns to the original position to immobilize the pivot mechanism 804 and lock the blade member 803 in place wherein use of the finishing blade edge 806 is provided. Applying the finishing blade edge 806 to the same layer of compound provides a means whereby the triangular spaces created from the initial application blade edge 805 are filled in by the cascading material from the tips of the conversely triangular mass thereby achieving a consistently uniform layer of compound spread in practically the same amount of time as the first of two or more applications using the standard method of conventional tools. Furthermore, the blade member 803 and/or the plate member 802 can be detachable and snap-on, providing a means to accommodate varying sizes, blade shapes and varying alternate blade edge configurations 809 810 for different tool uses and purposes such as for scraping, working, polishing or cleaning a surface.

Figure 9:
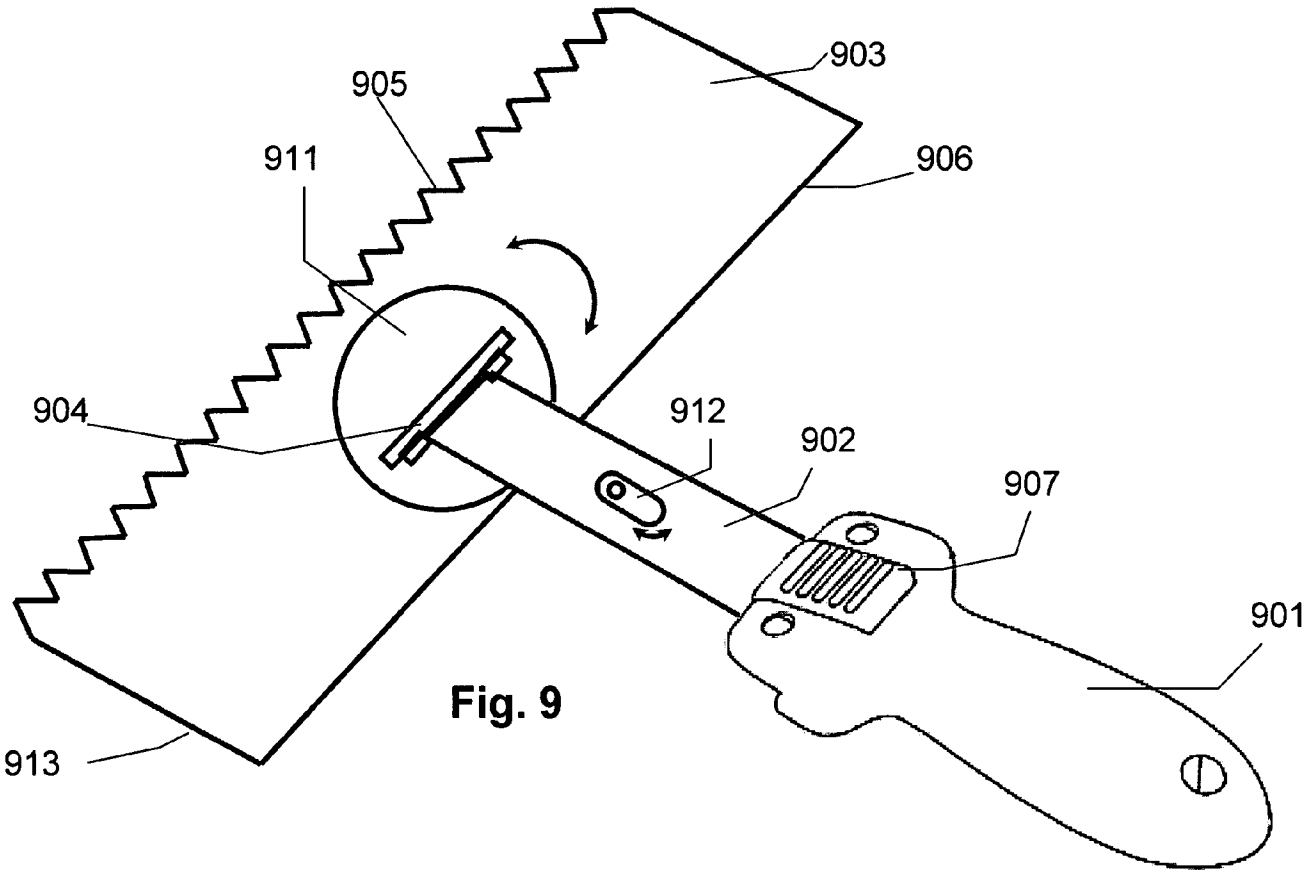
FIG. 9 is an isometric view illustrating a rotating pivot coupling the blade member to the plate member activating a selected edge, secured and locked in accordance with an embodiment of the invention.
Figure 10:
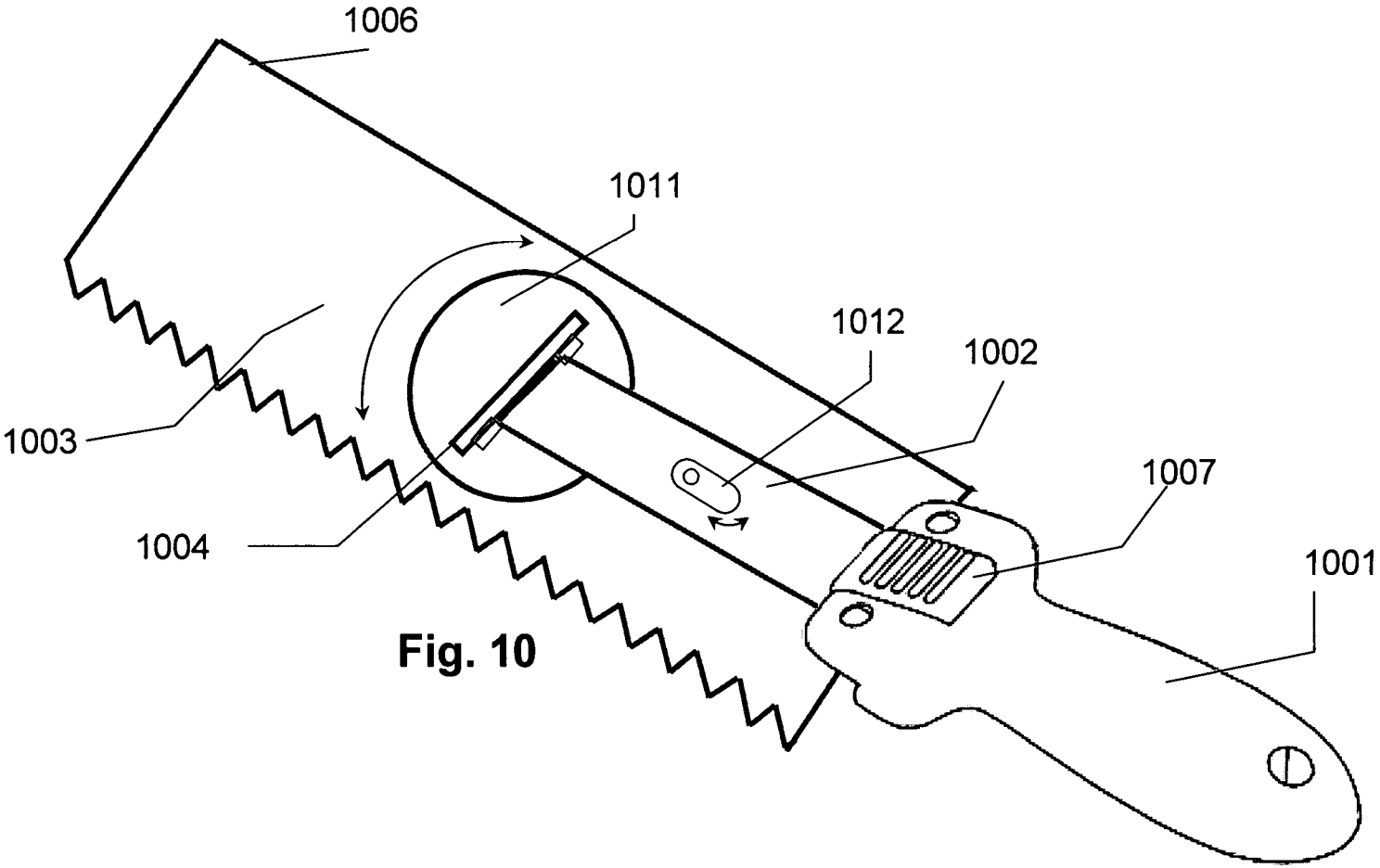
FIG. 10 is an isometric view illustrating a rotating pivot coupling the blade member to the plate member activating a selected edge, secured and locked in accordance with an embodiment of the invention.

FIG. 9 and FIG. 10 are isometric views illustrating a rotating pivot coupling the blade member to the plate member activating a selected edge, secured and locked in accordance with an embodiment of the invention.

In an embodiment of the invention illustrated in FIG. 9 and FIG. 10, and maintaining consistency of figure label numbers from previous figures, the component members are listed as a handle 901 1001, a plate member 902 1002, a blade member 903 1003, a pivot mechanism 904 1004, rotating mechanism 911 1011, one blade edge or the initial application blade edge 905 1005, an opposite blade edge or the finishing blade edge 906 1006, a locking slider 907 1007, and a swivel lock stabilizer 912 1012, and a scraping edge 913 1013.

In accordance with an embodiment of the invention illustrated, a compound is spread initially utilizing a jig saw or zig-zag blade edge 905 1005. Activated by a manual manipulation, the release mechanism of the locking device 907 1005 disengages the locking device 907 1007 and releases the blade member 903 1003 which allows the pivot mechanism 904 1004 coupled to the rotating mechanism to operate and the blade member 903 1003 to rotate from one blade edge 905 1003 to the short scraper blade edge 913 1013 or alternatively flip pivot to the initial application blade edge 905 1013 on the opposite blade edge 906 1006. The rotating mechanism may be of any circular slider, bearing, roller or other type, snap on or otherwise detachable or permanently coupled to the plate member 902 1002. In some embodiments, the pivot mechanism 904 1004 is coupled directly to the plate member 902 1002 and the rotating mechanism is coupled to the pivot member 904 1004.

Furthermore, the blade member 903 1003 can be detachable, snap-on to/from the plate member 902 1002, providing a means to accommodate varying sizes, blade shapes and varying alternate blade edge configurations 909 910 for different tool uses and purposes such as for scraping, working, polishing or cleaning a surface.

The method and apparatus of the invention is faster, more efficient, minimizes waste and does not require a high level of skill to achieve spreading a consistently uniform layer of compound on most surfaces. Moreover, the present invention will be greatly appreciated by those possessing a higher or lower level of skill in the trade, as time is saved by either in effort otherwise expended to complete the task or to learn how to use the tools to complete the task. Furthermore, the blade member and/or the plate member can be detachable thus allowing for varying sizes with varying blade edge configurations for other applications.

Although the detailed description above contains specificities, these should not be construed as limitations on the scope of the invention, but rather as an exemplification of one preferred embodiment thereof. Other variations are possible. For example, the size of all of the components can vary, the shapes of the individual components can vary, the materials used for any component members may vary, the position and type of locking device can vary and the type of pivot mechanism is variable and the blade edge configurations are variable.

Therefore, while the invention has been described with respect to a limited number of embodiments, those skilled in the art, having benefit of this invention, will appreciate that other embodiments can be devised which do not depart from the scope of the invention as disclosed herein. Accordingly, the scope of the invention should be limited only by the attached claims. Other aspects of the invention will be apparent from the following description and the appended claims.

What is claimed is:

1. A tool apparatus using one or more flat blades for surface working, comprising:

a handle;

a blade member having at least a first and second working edges;

a plate member coupling the handle to the blade member;

a pivot mechanism coupling the plate member to the blade member the blade member free to pivot for selectively extending either of the first or second working edge, whereby a user can actively set alternate working edges while using the tool; and a pivot member coupled to rotatable mechanism providing the blade an added rotational degree of freedom perpendicular to the pivot axis such that the multi-edged blade can be affixed to add additional blade utility by rotating an edge perpendicular to the handle axis and set in a stable position for use.

2. A tool apparatus as in claim 1 further comprising a locking mechanism configured to constrain the movement of the blade member for the spreading of a compound with either the first working edge or the second working edge as a trowel when in a locked mode, and releasing the blade member for selecting either said first or second working edge with in an unlocked mode.

3. A tool apparatus as in claim 1 further comprising interchangeable blades for spreading a compound in a layer onto a surface uniformly or for use as a flat blade tool.

4. A tool apparatus as in claim 1 wherein the handle can be made form alternate materials such as wood, plastic, metal, composites, rubber, and combinations.

5. A tool apparatus as in claim 1 wherein the handle is be rotatable with respect to the blade orientation.

6. A tool apparatus as in claim 1 wherein the blade has an aspect ratio adjusted for its designed use.

7. A tool apparatus as in claim 1 wherein the blade can be replaced with another blade of alternate shape.

8. A tool apparatus as in claim 1 wherein the blade has selectable edge patterns.

9. A tool apparatus as in claim 1 wherein the blade has selectable thickness.

10. A tool apparatus as in claim 1 wherein the blade has selectable material stiffness for flexibility as a trowel, scrapper, spatula, or the like.

11. A tool apparatus as in claim 1 wherein the blade pivot mechanism can be manipulated and controlled from the handle as a trowel, scrapper, spatula, or the like.

12. A tool apparatus as in claim 1 wherein the component part materials are selectable from metal, plastic, composites, wood, or combination thereof and whose stiffness and flexibility are related to the member function in the tool's use as a trowel, scrapper, spatula, or the like.

* * * * *